United States Patent [19]

Ikeda et al.

[11] Patent Number: 4,734,014

[45] Date of Patent: Mar. 29, 1988

[54] SHOE-AND SOCKET JOINT BETWEEN SWASH PLATE AND PISTONS OF SWASH PLATE TYPE COMPRESSOR

[75] Inventors: Hayato Ikeda; Mitsuru Hasegawa; Hiroshi Onomura, all of Kariya, Japan

[73] Assignee: Kabushiki Kaisha Toyoda Jidoshokki Seisakusho, Aichi, Japan

[21] Appl. No.: 67,636

[22] Filed: Jun. 26, 1987

[30] Foreign Application Priority Data

Jul. 1, 1986 [JP] Japan ..... 61-101012

[51] Int. Cl.[4] ..... F04B 1/16; F04B 1/18; F04B 3/00

[52] U.S. Cl. ..... 417/269; 92/71; 74/60

[58] Field of Search ..... 417/269; 92/71; 74/60

[56] References Cited

U.S. PATENT DOCUMENTS 4,662,267 5/1987 Kaku et al. ..... 417/269
4,683,803 4/1987 Miller et al. ..... 417/269

FOREIGN PATENT DOCUMENTS 135990 6/1986 Japan ..... 417/222

*Primary Examiner*—William L. Freeh
*Attorney, Agent, or Firm*—Burgess, Ryan & Wayne

[57] ABSTRACT

A shoe-and-socket joint, which is incorporated into a swash plate type compressor as a drive force transmitting unit arranged between a rotatable swash plate and each of a plurality of reciprocal pistons, has a shoe provided with a spherically formed contact face having a radius R2 and a spherically formed socket recessed in each of the pistons and having a radius R1, the radius R1 being 20 to 150 microns larger than the radius R2, to provide a clearance between the shoe surface and the surface of the socket into which an oil-containing refrigerant can flow to lubricate the shoe surface and the surface of the socket.

5 Claims, 6 Drawing Figures

SHOE-AND SOCKET JOINT BETWEEN SWASH PLATE AND PISTONS OF SWASH PLATE TYPE COMPRESSOR

BACKGROUND OF THE INVENTION

1. Field of the Invention

The present invention relates to a swash plate type compressor for use in an air-conditioning system for vehicles, and in particular, to an improved structure of a shoe-and-socket joint between a swash plate and a piston of a swash plate type compressor for providing sliding contact surfaces of the shoe and the socket of the piston with a better lubrication by the oil-contained refrigerant.

2. Description of the Related Art

A typical swash plate type compressor is disclosed in, for example, U.S. Pat. No. 4,329,913 of Nakayama et al. The compressor has a pair of horizontally axially aligned cylinder blocks which form a combined cylinder block. Axially extending cylinder bores and a swash plate chamber receiving a swash plate therein are formed inside the combined block, and the combined cylinder block is closed at both ends by front and rear housings, via valve plates. A drive shaft passes through the center of the combined block, and is rotatably supported by suitable radial and thrust bearing. The swash plate is fixed at the middle of the drive shaft and is operatively connected, via ball bearings and shoes, to double-headed pistons slidably fitted in the cylinder bores. Thus, the rotating motion of the swash plate within the swash plate chamber causes the reciprocal compression and suction motions of the pistons within the cylinder bores. The front and rear housings are provided with refrigerant suction chambers and refrigerant discharge chambers, which are interconnected with the cylinder bores and are connectable to an outside air-conditioning system by appropriate refrigerant flow pipelines. In other conventional types of swash plate, for example, as disclosed in the pending U.S. patent application Ser. No. 897,550, filed on Aug. 15, 1986, by M. Kato et al, and assigned to the same assignee as the present application, the ball bearings and shoes are replaced with semi-spherical shoes having a spherical contact face arranged in sliding contact with a spherical socket formed in the piston and a flattened contact face opposite to the spherical contact face and in sliding contact with the face of the swash plate.

However, in the above-mentioned conventional swash plate type compressor, the spherical socket of the piston is designed and formed to have substantially the same diameter as that of the ball or spherical face of the semi-spherical shoe, so that a completely complementary engagement is established between the piston and the ball or semi-spherical shoe. That is, there is no clearance between the piston and the ball or semi-spherical shoe. This makes it difficult for the oil-contained refrigerant in the swash plate chamber to flow between the spherical socket and the ball or semi-spherical shoe, and as a result, a lack of lubrication occurs in the sliding contact surfaces of the ball or semi-spherical shoe and the spherical socket of the piston. Thus, in a long operation of the swash plate type compressor, an abrasion at the outer edge of the spherical socket of the piston occurs. Accordingly, due to such abrasion, an accurate transmission of a drive force from the rotating swash plate to the reciprocating pistons can not be always achieved and eventually, a smooth and precise compression motion of the swash plate type compressor becomes impossible. Also, in this case, noise is generated by contact between the shoes and the sockets of the double-headed pistons in the swash plate type compressor.

SUMMARY OF THE INVENTION

An object of the present invention is to obviate the above-mentioned defects encountered by the conventional swash plate type compressor.

Another object of the present invention is to provide an improved structure of a shoe-and-socket joint linking a swash plate and a piston of a swash plate type compressor.

A further object of the present invention is to provide a novel structure of a spherical socket of a piston of a swash plate type compressor, to receive therein a spherical or semi-spherical shoe and permit an oil-containing refrigerant to flow onto the contact surfaces between the shoe and the socket of the piston during the operation of compressing the refrigerant.

In accordance with the present invention, there is provided a swash plate type compressor having a refrigerant-lubricated shoe-and-socket joint for transmitting an axial force from a rotating swash plate mounted on a drive shaft to a piston of the compressor, which applies an axially reciprocal compression effect to a refrigerant within a cylinder bore of the compressor. The refrigerant lubricated shoe-and-socket joint comprises a shoe having a flat contact face in sliding contact with the swash plate and a spherical body provided with a substantially spherical contact face arranged opposite to the flat contact face, and a socket in the shape of a spherically recessed face formed in the piston and in sliding contact with the substantially spherical contact face of the spherical body of the shoe. The spherically recessed face of the socket of the piston having a radius which is 20 through 150 microns larger than that of the spherical contact face of the spherical body of the shoe.

Preferably, the substantially spherical contact face of the spherical body of the shoe is provided with a flattened portion at an apex thereof, thereby defining a cavity for retaining the oil component of the refrigerant between the spherical contact face of the shoe and the spherically recessed face of the socket.

Preferably, the spherically recessed face of the socket of the piston has a shallow concave portion in substantially the center thereof, to define a cavity for retaining the oil component of the refrigerant between the spherical contact face of the shoe and the spherically recessed face of the socket.

DESCRIPTION OF THE DRAWINGS

The above and other objects, features and advantages of the present invention will become more apparent from the accompanying drawings wherein.

DESCRIPTION OF THE PREFERRED EMBODIMENTS

Figure 1:
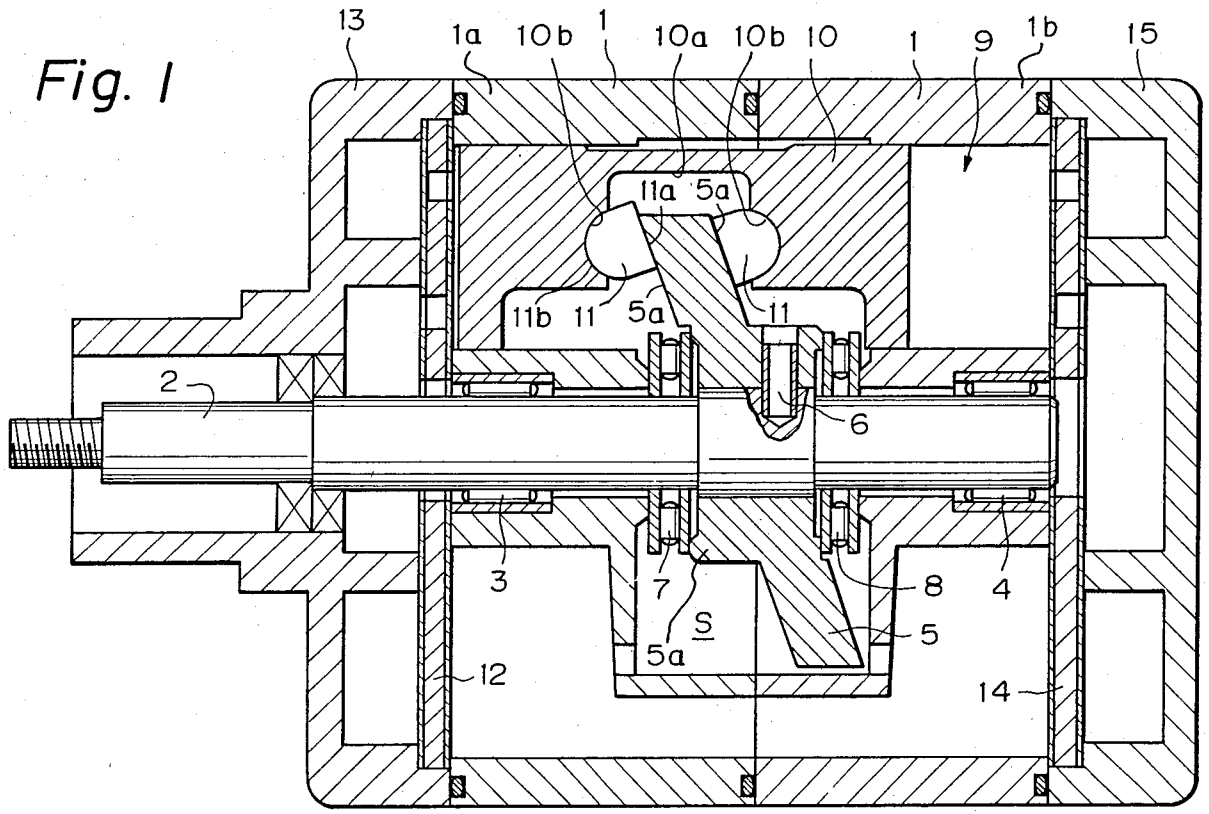
FIG. 1 is a longitudinal cross-sectional view of a swash plate type compressor illustrating a general construction of the compressor in which a shoe-and-socket joint according to the present invention is accommodated.

Referring to FIG. 1, illustrating a typical swash plate type compressor for use in a vehicle air-conditioning system, the compressor has a cylinder block 1 formed by combining a front cylinder block 1*a* and a rear cylinder block 1*b*. The cylinder block 1 is provided with axially extending cylinder bores 9 arranged equiangularly in the circumferential direction of the cylinder block 1 and parallel with each other around the central axis of the cylinder block 1. The front end of the cylinder block 1 is closed by a front housing 13, via a valve plate 12, and the rear end of the cylinder block is closed by a rear housing 15, via a valve plate 14. Passing centrally through the cylinder block 1, the front housing 13, and the valve plate 12, a drive shaft 2 is rotatably supported by a front anti-friction bearing 3 and a rear anti-friction bearing 4, and is provided with a swash plate 5 secured thereon by a suitable fixing pin 6. The swash plate 5 has a central boss portion 5*a* which is axially supported by front and a rear thrust bearings 7 and 8 intervened between the boss portion 5*a* and the front and rear cylinder blocks 1*a* and 1*b*.

Double-headed pistons 10 are slidably fitted in the respective cylinder bores 9 of the cylinder 1 to carry out a reciprocatory suction and compression of a refrigerant gas. Each of the pistons 10 has, at the axially central portion thereof, a recess 10*a* opening toward the center of the axis of the drive shaft 2 and permitting the swash plate 5 to pass therethrough when rotating. The swash plate 5 is provided with two oblique faces 5*a* which are inclined from the vertical plane with respect to the central axis of the drive shaft 2. The swash plate 5 is operatively connected to the respective pistons 10 by a pair of shoes 11. Each of the shoes 11 has the shape of a substantially semi-sphere and has a flat contact face 11*a* in contact with one of the oblique faces 5*a* of the swash plate 5 and a spherical contact face 11*b* slidably engaged in one of a pair of axially opposed spherical sockets 10*b* recessed in the recess 10*a* of each piston 10. The swash plate 5 supported on the drive shaft 2 rotates within a swash plate chamber S formed in the center of the cylinder block 1, and the rotation of the swash plate 5 causes the reciprocating motion of the pistons 10 in the cylinder bores 9. The refrigerant gas containing a lubricating oil is returned from the vehicle air-conditioning circuit and enters suction chambers formed in the front and rear housings 13 and 15. The refrigerant gas is then pumped into the cylinder bores 9, due to the sucking operation of the reciprocating pistons 10, and is compressed by the pistons 10 within the cylinder bores 9. The compressed refrigerant is discharged toward discharge chambers formed in the front and rear housings 13 and 15, and is subsequently sent to the outside air-conditioning circuit.

Figure 2:
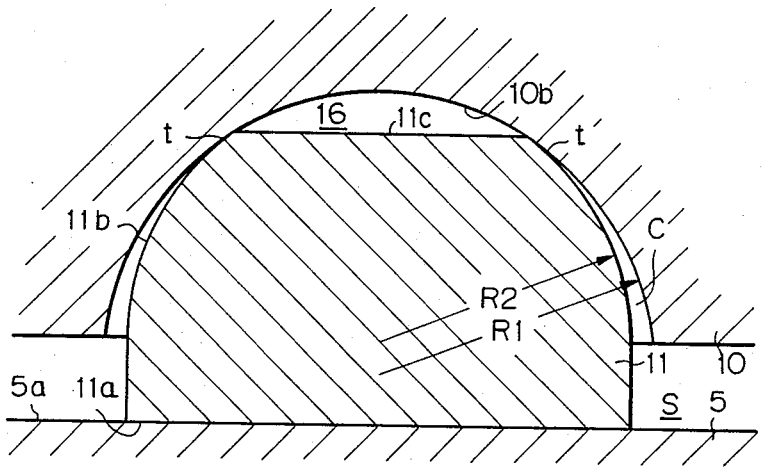
FIG. 2 is an enlarged cross-sectional view of a shoe-and-socket joint according to a first embodiment of the present invention.

Referring to FIG. 2 illustrating, on an enlarged scale, a shoe-and-socket joint according to a first embodiment of the present invention, the shoe 11 has a flat contact face 11*a* in contact with the swash plate 5, and a body provided with a spherically-formed contact face 11*b* having a partial cylindrical face portion adjacent to the flat face 11*a*. The spherically-formed contact face 11*b* has a radius R1. The piston 10 has a spherical socket 10*b* for receiving the spherically-formed contact face 11*b* of the shoe 11, and the spherical socket 10*b* has a radius R1 which is larger than the radius R2 of the shoe 11 by 20 to 150 microns (μm), so that there is a clearance C between the spherically-formed contact face 11*b* of the shoe 11 and the spherical socket 10*b* of the piston 10. The clearance C becomes larger in the outer portion of the spherical socket 10*b*, and has a knife edge shape in cross-section as shown in FIG. 2. At this stage, it should be understood that FIG. 2 illustrates the clearance C when the compressor is stopped and, therefore, the swash plate 5 is not rotated. The shoe 11 also has a flattened portion 11*c* formed at the apex thereof, to provide a cavity 16 between the flattened portion 11*c* and the surface of the spherical socket 10*b* of the piston 10.

The operation of the shoe-and-socket joint to be incorporated in a swash plate type compressor according to the first embodiment of the present invention will be explained below with reference to FIGS. 1 through 5.

Figure 3:
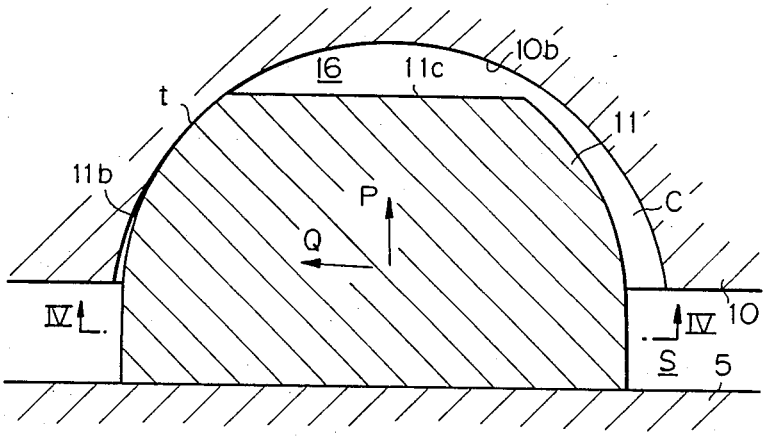
FIG. 3 is an enlarged cross-sectional view of the shoe-and-socket joint of FIG. 2, illustrating an operational state of the joint.
Figure 4:
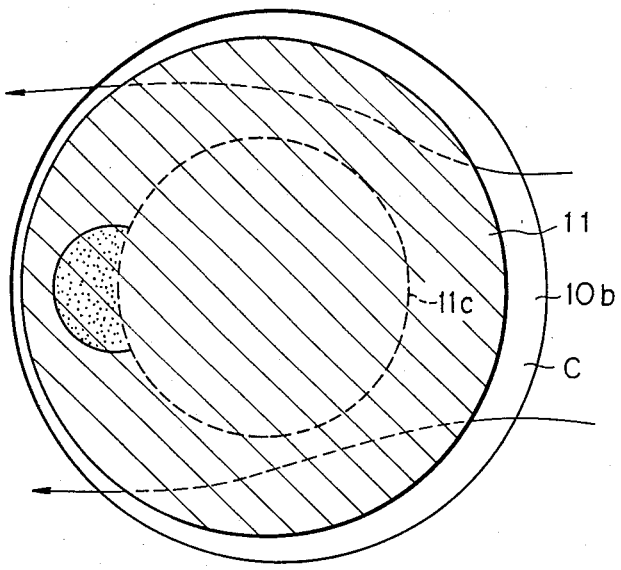
FIG. 4 is a cross-sectional view of the shoe and socket joint taken along the line IV—IV of FIG. 2.

When the drive shaft 2 is driven by a vehicle engine via an appropriate transmission mechanism, the swash plate 5 supported on the drive shaft 2 is also rotated. The rotation of the swash plate 5 causes the reciprocating motions of the respective pistons 10, to draw in and compress the refrigerant gas. During the compression motion of each of the pistons 10, the shoe 11 of the shoe-and-socket joint of the compressor is subjected to a first pressure component P shown in FIG. 3, to cause a sliding motion of each piston 10, and a second pressure component Q shown in FIG. 3, vertical to the first pressure component P and in parallel with the rotating direction of the swash plate. These pressure components P and Q are exerted by the oblique faces 5*a* of the swash plate 5. Each shoe 11 subjected to the pressure components P and Q is pressed against the associated spherically recessed socket 10*b* of the piston 10 and, therefore, as illustrated in FIG. 4, a part (a small fragmented circle portion) of the spherical contact face 11*b* of the pressed shoe 11 is brought into close contact with the associated socket 10*b* of the piston 10. As a result, the clearance C around the closely contacting part of the spherical contact face 11*b* of the pressed shoe 11 is increased, to allow a predetermined amount of fluid communication between the cavity 16 and the swash plate chamber S, as illustrated in FIGS. 3 and 4. Consequently, the oil-containing refrigerant gas is permitted to flow from the swash plate chamber S toward the cavity 16 between the spherical contact face 11*b* of each shoe 11 and the associated spherical socket 10*b* of each piston 10, lubricating the spherical contact face 11*b* and the associated spherical socket 10*b*. The oil-containing refrigerant lubricates the above-mentioned small fragmented circle portion of the spherical contact face 11*b* of the pressed shoe 11 as well as a portion of the spherical socket 10*b* with which the small fragmented circle portion of the spherical contact face 11*b* of the pressed shoe 11 is in contact while the swash plate 5 is rotating and the piston 10 is moving. That is, as each shoe 11 moves slidingly relative to the associated spherical socket 10*b* of the piston 10 during the rotation of the swash plate 5, the refrigerant gas lubricates the entire surface of the spherical contact face 11*b* of the shoe 11 as well as the entire surface of the spherically recessed socket 10*b* of the piston 10. Accordingly, abrasion of the surfaces of both the shoe 11 and the socket 10*b* of the piston 10 can be remarkably reduced.

The present inventors conducted an abrasion test while changing the value of the difference between the afore-mentioned two radii R1 and R2 of each shoe 11 and the socket 10*b* of each piston 10.

Figure 5:
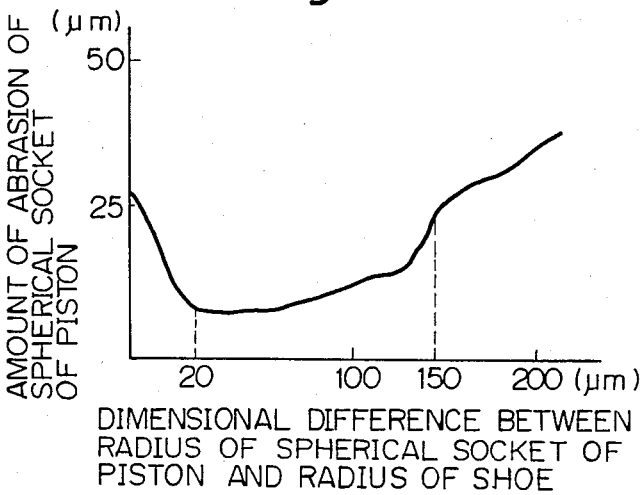
FIG. 5 is a graph illustrating the relationship between the dimensional difference between the radius of the spherical recessed face of the socket of the piston and the radius of the spherical body of the shoe, and the amount of abrasion of the socket of the piston; and, FIG. 6 is an enlarged cross-sectional view of a shoe-and-socket joint according to a second embodiment of the present invention.

The graph of FIG. 5 indicates the results of the test. The abscissa of the graph indicates the dimensional difference between the radii R1 and R2, while the ordinate indicates the amount of abrasion of the spherical socket 10*b* of the piston 10. From the indication of the graph of FIG. 5, it will be understood that, when the dimensional difference between the two radii R1 and R2 is in the range of 20 microns to 150 microns, the amount of abrasion is very small.

Figure 6:
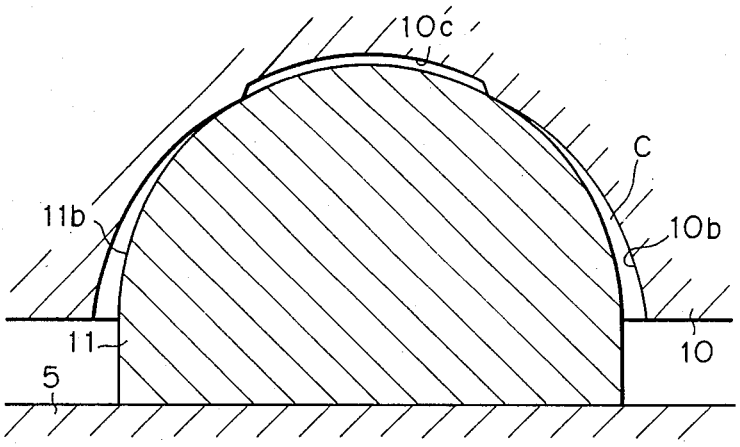

FIG. 6 illustrates a second embodiment of the shoe-and-socket joint. In the shoe-and-socket joint of FIG. 6, the dimensional relationship between the radius R2 of the shoe 11 and the radius R1 of the spherical socket 10*b* of the piston 10 is the same as the shoe-and-socket joint of the first embodiment of FIGS. 2 through 4. However, the shoe 11 of the second embodiment is not provided with a flattened portion at the apex thereof, but the spherical socket 10*b* of the piston 10 has a shallow concave portion 10*c* formed at the center thereof, into which the oil-containing refrigerant within the swash plate chamber S flows when the shoe 11 is moved from the center of the spherical socket 10*b* due to the pressure exerted by the rotating swash plate 5. That is, the concave portion 10*c* is substantially the same as the cavity 16 of the first embodiment, and accordingly, sufficient lubrication is applied to the shoe 11 and the spherical socket 10*b* of the piston 10.

From the foregoing description of the preferred embodiments of the present invention, it will be understood that, according to the present invention, the shoe-and-socket joint incorporated in a swash plate type compressor can be sufficiently lubricated by the oil-containing refrigerant during the operation of the compressor. Therefore, abrasion of the shoes and the associated spherical sockets is prevented, and the operational life of the compressor per se can be prolonged.

It should be understood that variations and modifications will occur to those skilled in the art within the scope and spirit of the present invention as claimed in the appended claims.

We claim:

1. A shoe-and-socket joint incorporated into a swash plate type compressor for transmitting an axial force from a rotating swash plate supported on a drive shaft to a piston of the compressor, which piston applies an axially reciprocal compression effect to a refrigerant containing a lubricating oil component within a cylinder bore of the compressor, comprising:

a shoe having a flat contact face in sliding contact with said swash plate and a spherical body provided with a substantially spherical contact face arranged opposite to said flat contact face; and, a socket in the shape of a spherically recessed face formed in said piston and in sliding contact with said substantially spherical contact face of said spherical body of said shoe, said spherically recessed face of said socket of said piston having a radius 20 to 150 microns larger than that of said spherical contact face of said spherical body of said shoe.

2. A shoe-and-socket joint according to claim 1, wherein said substantially spherical contact face of said spherical body of said shoe is provided, at an apex thereof, with a flattened portion which defines a cavity for permitting said oil component of said refrigerant to flow between said spherical contact face of said shoe and said spherically recessed face of said socket.

3. A shoe-and-socket joint according to claim 1, wherein said spherically recessed face of said socket of said piston has a shallow concave portion in substantially the center thereof, to thereby define a cavity for permitting said oil component of said refrigerant to flow between said spherical contact face of said shoe and said spherically recessed face of said socket.

4. A shoe-and-socket joint according to claim 1, wherein said piston is a double headed piston reciprocating in said cylinder bore, said piston having a central recess for permitting said swash plate to pass therethrough during rotating thereof, and a pair of said spherically recessed sockets opposingly formed in said central recess, and wherein a pair of said shoes respectively having said spherical contact face are slidably engaged in said pair of said spherically recessed sockets of said double-headed piston.

5. A swash plate type compressor comprising a pair of horizontal axially aligned front and rear cylinder blocks combined to form a cylinder block; a swash plate rotatably mounted on a drive shaft rotatably supported in the center of said combined cylinder block, said swash plate being provided with opposite oblique faces inclined with respect to the axis of rotation of said swash plate; a swash plate chamber formed in the center of said combined cylinder block for rotatably receiving therein said swash plate and for receiving an oil-containing refrigerant returned from an outside refrigerating circuit; a plurality of cylinder bores axially extending through said combined cylinder block and equiangularly arranged around the central axis of said combined cylinder block; a plurality of double-headed compressor pistons slidably fitted in said plurality of cylinder bores to compress the oil-containing refrigerant within said cylinder bores; and, a plurality of shoe-and-socket joints arranged between said opposite oblique faces of said swash plate and said plurality of said double-headed pistons, each of said shoe-and-socket joints comprising, a shoe having a flat contact face in sliding contact with one of said oblique faces of said swash plate and a spherical body provided with a substantially spherical contact face arranged opposite to said flat contact face; and, a socket in the shape of a spherically recessed face formed in each of said piston and in sliding contact with said substantially spherical contact face of said spherical body of said shoe, said spherically recessed face of said socket of said piston having a radius 20 to 150 microns larger than that of said spherical contact face of said spherical body of said shoe.

* * * * *